US006921439B2

(12) United States Patent
Warichet et al.

(10) Patent No.: US 6,921,439 B2
(45) Date of Patent: Jul. 26, 2005

(54) FLUX AND PROCESS FOR HOT DIP GALVANIZATION

(75) Inventors: David Warichet, Brussels (BE); Karel Van Herck, Mechelen (BE); André Van Lierde, B-Brixelles (BE); Nathalie Gerain, Louvain-la-Neuve (BE); Edward Matthijs, Wetteren (BE)

(73) Assignee: Galva Power Group N.V., Halen (BE)

( * ) Notice: Subject to any disclaimer, the term of this patent is extended or adjusted under 35 U.S.C. 154(b) by 26 days.

(21) Appl. No.: 10/437,925

(22) Filed: May 15, 2003

(65) Prior Publication Data

US 2003/0219543 A1 Nov. 27, 2003

Related U.S. Application Data

(63) Continuation of application No. PCT/EP01/13671, filed on Nov. 23, 2001.

(30) Foreign Application Priority Data

Nov. 23, 2000 (EP) ..... 00125668

(51) Int. Cl.[7] ..... B23K 35/363
(52) U.S. Cl. ..... 148/26

(58) Field of Search ..... 148/26

(56) References Cited

U.S. PATENT DOCUMENTS 4,168,972 A * 9/1979 Dreulle ..... 420/519

FOREIGN PATENT DOCUMENTS

| | | |
|---|---|---|
| EP | 0 924 314 | 6/1999 |
| JP | 02050946 | 2/1990 |
| JP | 02070050 | 3/1990 |
| JP | 04154951 | 5/1992 |
| JP | 05195179 | 8/1993 |

* cited by examiner

*Primary Examiner*—Daniel Jenkins
(74) *Attorney, Agent, or Firm*—Nath & Associates PLLC; Gregory B. Kang; Derek Richmond

(57) ABSTRACT

A flux for hot dip galvanization comprises from 60 to 80 wt % of zinc chloride ($ZnCl_2$); 7 to 20 wt % of ammonium chloride ($NH_4Cl$); 2 to 20 wt % of a fluidity modifying agent comprising at least one alkali or alkaline earth metal; 0.1 to 5 wt % of at least one of the following compounds: $NiCl_2$, $CoCl_2$, $MnCl_2$ and 0.1 to 1.5 wt % of at least one of the following compounds: $PbCl_2$, $SnCl_2$, $BiCl_3$ and $SbCl_3$.

25 Claims, No Drawings

FLUX AND PROCESS FOR HOT DIP GALVANIZATION

This application is a continuation application of International Application No. PCT/EP01/13671, having an International Filing Date of Nov. 23, 2001, the entire contents of which are hereby incorporated by reference in its entirety.

FIELD OF THE INVENTION

The present invention generally relates to a flux and a fluxing bath for hot dip galvanization, to a process for the hot dip galvanization of an iron or steel article and to a hot dip galvanizing bath.

BACKGROUND OF THE INVENTION

Conventional hot dip galvanization consisting of dipping iron or steel articles in a molten zinc bath requires careful surface preparation, in order to assure adherence, continuity and uniformity of the zinc coating. A conventional method for preparing the surface of an iron or steel article to be galvanized is dry fluxing, wherein a film of flux is deposited on the surface of the article. Accordingly, the article generally undergoes a degreasing followed by rinsing, an acid cleaning also followed by rinsing, and a final dry fluxing, i.e. the article is dipped in a fluxing bath and subsequently dried. The basic products employed in conventional fluxing are generally zinc and ammonium chlorides.

It is well known that improvement in the properties of galvanized articles can be achieved by alloying zinc with aluminum. For example, addition of 5% aluminum produces a zinc aluminum alloy with the lowest melting temperature. This alloy exhibits improved fluidity properties relative to pure zinc. Moreover, galvanized coatings produced from this zinc-aluminum alloy have greater corrosion resistance (from two to six times better than that of pure zinc), improved formability and better paintability than those formed from pure zinc. Furthermore, galvanized coatings free from lead can be made with this technology.

However, the use of conventional fluxes in zinc-aluminum galvanizing leads to various defects in the coatings. In particular, some areas of the surface may not be covered, or not covered in a sufficient manner, or the coating may show outbursts, black spots or even craters, which give the article unacceptable finish and/or corrosion resistance. Thus, research has been carried out to develop fluxes that are more adapted to zinc-aluminum galvanizing. Despite these efforts, when it comes to the galvanizing of iron or steel articles in zinc-aluminum baths in batch operation, i.e. the galvanizing of individual articles, the known fluxes are still not satisfactory.

OBJECT OF THE INVENTION

The object of the present invention is to provide a flux that makes it possible to produce continuous, more uniform, smoother and void-free coatings on iron or steel articles by hot dip galvanization with zinc-aluminum alloys. This problem is solved by a flux as claimed in claim 1.

SUMMARY OF THE INVENTION

A flux for hot dip galvanization in accordance with the invention comprises:

60 to 80 wt. % (percent by weight) of zinc chloride ($ZnCl_2$);

7 to 20 wt. % of ammonium chloride ($NH_4Cl$);

2 to 20 wt. % of at least one alkali or alkaline earth metal salt 0.1 to 5 wt. % of a least one of the following compounds: $NiCl_2$, $CoCl_2$, $MnCl_2$; and 0.1 to 1.5 wt. % of at least one of the following compounds: $PbCl_2$, $SnCl_2$, $SbCl_3$, $BiCl_3$.

By "hot dip galvanization" is meant the galvanizing of an iron or steel article by dipping in a molten bath of zinc or zinc-alloy, in continuous or batch operation.

Such a flux, wherein the different percentages relate to the proportion in weight of each compound or compound class relative to the total weight of the flux, makes it possible to produce continuous, more uniform, smoother and void-free coatings on iron or steel articles by hot dip galvanization with zinc-aluminum alloys, especially in batch operation. The selected proportion of $ZnCl_2$ ensures a good covering of the article to be galvanized and effectively prevents oxidation of the article during drying of the article, prior to the galvanization. The proportion of $NH_4Cl$ is determined so as to achieve a sufficient etching effect during hot dipping to remove residual rust or poorly pickled spots, while however avoiding the formation of black spots, i.e. uncovered areas of the article. The alkali or alkaline earth metals, in the form of salts, are employed to modify the activity of the molten salts, as will be detailed below. The following compounds: $NiCl_2$, $CoCl_2$, $MnCl_2$, are believed to further improve by a synergistic effect the wettability of steel by molten metal. The presence in the flux of between 0.1 to 1.5 wt. % of at least one of $PbCl_2$, $SnCl_2$, $BiCl_3$ and $SbCl_3$ permits to improve the wetting of an iron or steel article, covered with this flux, by molten zinc in a galvanizing bath. Another advantage of the flux of the invention is that it has a large field of applicability. As mentioned, the present flux is particularly suitable for batch hot dip galvanizing processes using zinc-aluminum alloys but also pure zinc. Moreover, the present flux can be used in continuous galvanizing processes using either zinc-aluminum or pure zinc baths, for galvanizing e.g. wires, pipes or coils (sheets) . . . The term "pure zinc" is used herein in opposition to zinc-aluminum alloys and it is clear that pure zinc galvanizing baths may contain some additives such as e.g. Pb, Sb, Bi, Ni, Sn.

A preferred proportion of zinc chloride is between 70 and 78% by weight relative to the total weight of the flux. Regarding the ammonium chloride, a proportion of 11 to 15% by weight is preferred. The $NiCl_2$ content in the flux is preferably of 1% by weight. The flux should further preferably comprise 1% by weight of $PbCl_2$.

Referring more specifically to the alkali or alkaline earth metals, they are advantageously chosen from the group (sorted in decreasing order of preference) consisting of: Na, K, Li, Rb, Cs, Be, Mg, Ca, Sr, Ba. The flux shall advantageously comprise a mixture of these alkali or alkaline earth metals, as they have a synergistic effect which allows to control the melting point and the viscosity of the molten salts and hence the wettability of the surface of the article by the molten zinc or zinc-aluminum alloy. They are also believed to impart a greater thermal resistance to the flux. Preferably, the flux comprises 6% by weight of NaCl and 2% by weight of KCl.

According to another aspect of the invention, a fluxing bath for hot dip galvanization is proposed, in which a certain amount of the above defined flux is dissolved in water. The concentration of the flux in the fluxing bath may be between 200 and 700 g/l, preferably between 350 and 550 g/l, most preferably between 500 and 550 g/l. This fluxing bath is particularly adapted for hot dip galvanizing processes using zinc-aluminum baths, but can also be used with pure zinc galvanizing baths, either in batch or continuous operation.

The fluxing bath should advantageously be maintained at a temperature between 50 and 90° C., preferably between 60 and 80° C., most preferably of 70° C.

The fluxing bath may also comprise 0.01 to 2 vol. % (by volume) of a non-ionic surfactant, such as e.g. Merpol HCS from Du Pont de Nemours, FX 701 from Henkel, Netzmittel B from Lutter Galvanotechnik Gmbh or the like.

According to a further aspect of the invention, a process for the hot dip galvanization of an iron or steel article is proposed. At a first process step (a), the article is submitted to a degreasing in a degreasing bath. The latter may advantageously be an ultrasonic, alkali degreasing bath. Then, in a second step (b), the article is rinsed. At further steps (c) and (d) the article is submitted to a pickling treatment and then rinsed. It is clear that these pre-treatment steps may be repeated individually or by cycle if needed. The whole pre-treatment cycle (steps a to d) is preferably carried out twice. It shall be appreciated that at the next step (e) the article is treated in a fluxing bath in accordance with the invention so as to form a film of flux on the article's surface. The article may be immersed in the fluxing bath for up to 10 minutes, but preferably not more than 5 minutes. The fluxed article is subsequently dried (step f). At next step (g), the article is dipped in a hot galvanizing bath to form a metal coating thereon. The dipping time is a function of size and shape of the article, desired coating thickness, and of the aluminum content (when a Zn—Al alloy is used as galvanizing bath). Finally, the article is removed from the galvanizing bath and cooled (step h). This may be carried out either by dipping the article in water or simply by allowing it to cool down in the air.

The present process has been found to allow deposition of continuous, more uniform, smoother and void-free coatings on individual iron or steel articles, especially when a zinc-aluminum galvanizing bath was employed. It is particularly well adapted for the batch hot dip galvanizing of individual iron or steel articles, but also permits to obtain such improved coatings with wire, pipe or coil material continuously guided through the different process steps. More over, pure zinc galvanizing baths may also be used in the present process. Accordingly, the galvanizing bath of step (g) is advantageously a molten zinc bath, which may comprise from 0 to 56% by weight of aluminum and from 0 to 1.6% by weight of silicon. More specifically, this means that well known alloys such as:

SUPERGALVA®, a registered trademark of Mitsui Mining & Smelting Co. Ltd., Japan, containing essentially 3–7 wt. % Al, 0–3 wt. % Mg, 0–0.1 wt % Na, rest Zn;

GALFAN®, a registered trademark of International Lead Zinc Research Organization, Inc., containing essentially 4.2–7.2 wt. % Al, 0.03–0.10 wt. % mischmetals, rest Zn; or GALVALUME®, a registered trademark of BIEC International, Inc., containing essentially 55 wt. % Al, 1.6 wt. % Si, rest Zn;

may be used as galvanizing baths.

The galvanizing bath is preferably maintained at a temperature between 380 and 700° C.

At step (f) the article is preferably dried in a forced air stream heated at a temperature between 200 and 350° C., more preferably 250° C. Furthermore, it shall be noted that the surface of the article shall advantageously exhibit a temperature between 170 and 200° C. before being dipped into the galvanizing bath at step (g). This is possible as the fluxing bath of the invention has a high thermal resistance and is effective for limiting corrosion of the article. Preheating the article before step (g) facilitates the remelting of the frozen metal layer which forms on the surface of the article directly after immersion in the galvanizing bath.

For the same purpose of remelting the frozen metal layer, the article is advantageously moved in the galvanizing bath during at least the first minutes following its introduction therein. The agitation should be stopped before the removal of the article from the galvanizing bath to avoid deposition on the article's surface of dirt and scum overlying the galvanizing bath. Generally, the thicker and voluminous the article, the more intense the agitation. In addition, an inert gas, such as e.g. nitrogen ($N_2$) or argon (Ar), may be introduced into the galvanizing bath, preferably in the form of fine bubbles, so as to obtain a bubbling effect.

It shall be noted that the present process is adapted to galvanize steel articles made of a large variety of steels. In particular, steel articles having a carbon content up to 0.25 wt. %, a phosphorous content between 0.005 and 0.1 wt. % and a silicon content between 0.0005 and 0.5 wt. % may be galvanized with the present process. According to another aspect of the invention, a hot dip galvanizing bath is proposed. It comprises:

up to 56 wt. % of Al;

from 0.005 to 0.15 wt. % of Sb and/or from 0.005 to 0.15 wt. % of Bi;

maximum 0.005 wt. % of Pb, maximum 0.005 wt. % of Cd and maximum 0.002 wt. % of Sn; and the rest being essentially Zn.

Such a galvanizing bath permits to obtain improved coatings on iron or steel articles. The presence of selected concentrations of Sb and/or Bi in this galvanizing bath, combined with the limitation on the concentrations of Pb, Cd and Sn, is believed to improve the resistance to the formation of white rust and to intergranular corrosion of the obtained coatings. This is particularly observed when the aluminum content is between 2 and 56 wt. %. Moreover, obtained coatings are smooth and have an attracting appearance. This galvanizing bath is particularly well suited to be used in the process of the invention.

As indicated, Sb or Bi, which are supposed to have the same effect in the galvanizing bath, may be present in the bath separately or together in the prescribed amounts. However, a concentration from 0.005 to 0.04% by weight of Sb is preferred.

In another embodiment, the galvanizing bath is based on the composition of GALFAN®, to which Bi and/or Sb is/are added in accordance with the above prescribed amounts. Accordingly, the galvanizing bath comprises (in proportions by weight): 4.2–7.2% of Al, 0.005–0.15% of Sb and/or 0.005 to 0.15% of Bi, max. 50 ppm of Pb, as well as 0.03–0.10% of mischmetals, max. 150 ppm of Si, max. 750 ppm of Fe, max. 50 ppm of Cd, max. 20 ppm of Sn, with the remainder being essentially Zn, these proportions of Si, Fe, Cd and Sn being typical for GALFAN®. The galvanizing bath may also contain small amounts of Mg, Cu, Zr or Ti. It shall however be noted that, contrary to conventional specifications of GALFAN®, this galvanizing bath should preferably comprise: no more than 10 ppm, more preferably no more than 5 ppm, of Sn; no more than 25 ppm, more preferably no more than 12 ppm, of Pb; no more than 25 ppm, more preferably no more than 12 ppm of Cd. Indeed, these compounds are believed to promote intergranular corrosion. Furthermore, the galvanizing bath should comprise no more than 500 ppm, more preferably no more than 150 ppm of Mg. The limitation on the Mg content enhances the surface aspect of the finished products.

DETAILED DESCRIPTION OF A PREFERRED EMBODIMENT

To illustrate the present invention, preferred embodiments of the flux, process and galvanizing bath will now be described in detail, by way of example.

The flux allows to form continuous, more uniform, smoother and void-free coatings, especially on batchwise galvanized iron or steel articles. In a preferred embodiment, the flux composition is the following: 75 wt. % of $ZnCl_2$, 15 wt. % of $NH_4Cl$, 6 wt. % of NaCl, 2 wt. % of KCl, 1 wt. % of $NiCl_2$ and 1 wt. % $PbCl_2$.

The process mainly comprises the steps of pretreating an iron or steel article to be coated, treating it with the flux, coating it in a galvanizing bath containing a molten zinc-aluminum alloy and cooling it. This process is applicable for a large variety of steel articles, such as e.g. large structural steel parts as for towers, bridges and industrial or agricultural buildings, pipes of different shapes as for fences along railways, steel parts of vehicle underbodies (suspension arms, engine mounts . . . ), castings and small parts.

The pretreatment of the article is firstly carried out by dipping the article to be galvanized for 15 to 60 minutes in an alkali degreasing bath comprising: a salt mix including mainly sodium hydroxide, sodium carbonate, sodium polyphosphate as well as a tenside mix, such as e.g. Solvopol SOP and Emulgator SEP from Lutter Galvanotechnik GmbH. The concentration of the salt mix is preferably between 2 and 8 wt. % and that of the tenside mix is preferably between 0.1 and 5 wt. %. This degreasing bath is kept at a temperature of 60° C. to 80° C. An ultrasonic generator is provided in the bath to assist the degreasing. This step is followed by two water rinsings.

The pretreatment then continues with a pickling step, wherein the article is dipped for 60 to 180 minutes in a 10 to 22% aqueous solution of hydrochloric acid containing an inhibitor (hexamethylene tetramine, . . . ) and kept at a temperature of 30 to 40° C. to remove scale and rust from the article. This again is followed by two rinsing steps. Rinsing after pickling is preferably carried out by dipping the article in a water tank at a pH lower than 1 for less than 3 minutes, more preferably for about 30 seconds. It is clear that these steps of degreasing and pickling can be repeated if necessary.

The fluxing treatment is carried out in a fluxing bath, in which the above described flux is dissolved in water. The fluxing bath, in which the flux concentration preferably is between 350 and 550 gA, is maintained at a temperature of about 70° C. and its pH should be between 1.5 and 4.5. The article is dipped in the fluxing bath for not more than 10 minutes, preferably for about 3 to 5 minutes, whereby a layer of wet flux is formed on the article's surface.

The article is then dried in a forced air stream having a temperature of about 250° C. It shall be noted that the flux has a high thermal resistance. The article can therefore be dried with hot air, without any significant corrosion of the article. Moreover, the article is preferably dried until its surface exhibits a temperature of between 170 and 200° C. It is however clear that this preheating of the article, i.e. imparting a certain amount of heat to the article before the galvanizing, does not need to be carried out during the drying step following the fluxing. It can be performed in a separate preheating step, directly after the drying or, in case the article is not to be immediately galvanized, at a later stage.

In this preferred embodiment of the process, the galvanizing bath advantageously contains (in weight): 4.2–7.2% of Al, 0.005–0.15% of Sb and/or 0.005 to 0.15% of Bi, max. 50 ppm of Pb, max. 50 ppm of Cd, max. 20 ppm of Sn, 0.03–0.10% of mischmetals, max. 150 ppm of Si, max. 750 ppm of Fe, and the remainder of Zn. This galvanizing bath is maintained at a temperature of 380 to 700° C.

The fluxed and preferably preheated article is dipped for about 1 to 10 minutes in the galvanizing bath. It is clear that the dipping time mainly depends on the overall size and shape of the article and the desired coating thickness. During the first minutes of the dipping, the article is preferably moved in the bath so as to assist the remelting of the frozen metal layer that forms on the article surface. In addition, bubbling is advantageously carried out in the bath by means of $N_2$ introduced into the galvanizing bath in the form of fines bubbles. This can be achieved by providing e.g. a gas diffuser made of ceramic or sintered stainless steel, in the galvanizing bath. After the passage of an appropriate dipping time, the coated article is lifted from the bath at an appropriate speed, so that the liquid alloy may be removed from it, leaving a smooth, ripple-free, continuous coating on the article's surface.

Finally, the cooling of the coated article is carried out by dipping it in water having a temperature of 30° C. to 50° C. or alternatively, by exposing it to air. As a result, a continuous, uniform and smooth coating free from any voids, bare spots, roughness or lumpiness, is formed on the article's surface.

In order to further illustrate the present invention, three different steel samples were treated according to three different embodiments of the process. The chemical analysis of each steel sample was performed by spectroscopy with an OBLF QS750 equipment.

EXAMPLE 1

A steel plate, ref. 2130, of size 100×100 mm and thickness 2 mm was treated according to a first embodiment of the process. The composition (in percent by weight) of plate 2130 was the following: C, 0.091, Nb: 0.003, Si: 0.005, Pb: 0.001, Mn: 0.353, Co: 0.004, P: 0.009, W<0.003, S: 0.006, Al: 0.037, Cr 0.020, Ni: 0.025, Mo: 0.001, Cu: 0.009, B<0.0001, Ti<0.001, V: 0.004.

This plate 2130 was first degreased for 15 minutes in an alkaline degreasing bath at 70° C. containing 20 g/l of a salt mix (NaOH, $Na_2CO_3$, sodium polyphosphate, . . . ), named Solvopol SOP, and 1 g/l of a tenside mix, named Emulgator SEP; both from Lutter Galvanotechnick GmbH. An ultrasonic generator was provided in the bath to assist the degreasing. This step was followed by a water rinsing step carried out by successively dipping the plate in two dead rinsing baths (i.e. stagnant liquid). The pretreatment then continued with a pickling step, wherein the plate was dipped for 40 minutes in a pickling bath kept at a temperature of 30° C. and comprising 15 to 22% of an aqueous solution of hydrochloric acid to remove scale and dust from it. This pickling bath further comprised 3 g of hexamethylenetetramine per liter of hydrochloric acid (32%) and 2 g of C75 (from Lutter Galvanotechnik GmbH) per liter of the pickling bath. This again was followed by a rinsing in two successive rinsing baths. This pretreatment was then repeated: ultrasonic degreasing for 15 min, rinsing, pickling for 15 min at 30° C. After this second pickling step, the plate was rinsed for 15 min in a dead rinsing bath (rinsing bath 1) at pH 0 and for 5 min in a dead rinsing bath (rinsing bath 2) at pH 1 and room temperature.

The fluxing treatment was then carried out in a fluxing bath containing 500 g/l of a flux (composition: 75 wt. % $ZnCl_2$, 15 wt. % $NH_4Cl$, 1 wt. % $PbCl_2$, 1 wt. % $NiCl_2$, 6 wt. % NaCl and 2 wt. % KCl) dissolved in water. The fluxing bath was maintained at a temperature of about 70° C. and its pH was about 4.2. The plate was dipped for 3 minutes in the fluxing bath. The plate was then dried in a forced air stream having a temperature of 250° C. until its surface exhibited a temperature between 170 and 200° C.

The preheated, fluxed plate 2130 was then dipped for 5 minutes in a galvanizing bath containing (by weight): 5,42% of Al, max. 50 ppm of Pb, max. 50 ppm of Cd, max. 20 ppm of Sn, 0.03 to 0.10% of mischmetals, max. 150 ppm of Si, max. 750 ppm of Fe, and the remainder of Zn. This galvanizing bath was maintained at a temperature of 450° C. After removal from the galvanizing bath, the plate was allowed to cool down in the air. The plate 2130 exhibited a continuous, uniform, void-free, and perfectly smooth coating (no craters).

EXAMPLE 2

A steel plate, ref. 5808, of size 100×100 mm and thickness 5 mm was treated according to a second embodiment of the process. The composition (in percent by weight) of plate 5808 was the following: C: 0.095, Nb<0.001, Si: 0.204, Pb: 0.002, Mn: 0.910, Co: 0.004, P: 0.016, W<0.003, S: 0.014, Al: 0.001, Cr: 0.021, Ni: 0.021, Mo: 0.002, Cu: 0.008, B: 0.0002, Ti<0.001, V: 0.004.

The plate was first dipped for 15 min in an ultrasonic alkali degreasing bath (same conditions as for plate 2130 in Example 1) kept at a temperature of 70° C. and successively rinsed in two rinsing baths. The plate was then dipped for 120 min in a pickling bath containing 15 to 22% of HCl, 3 g of hexamethylene tetramine per liter HCl 32% and 2 g of C75 (Lutter) per liter of pickling bath. The bath was kept at a temperature of 30° C. and successively rinsed in two rinsing baths. The plate was then subjected to a second degreasing followed by rinsing as well as to a second pickling for 17 min at 30° C., followed by two successive immersions of 10 seconds each in rinsing baths 1 and 2 (see Example 1).

The plate was then fluxed in a fluxing bath containing 424 g/l of a flux (composition: 77,7 wt. % $ZnCl_2$, 15 wt. % $NH_4Cl$, 0,9 wt. % $PbCl_2$, 0,9 wt. % $NiCl_2$, 5,5 wt. % NaCl) dissolved in water. The plate was dipped for 4 minutes in the fluxing bath which was maintained at a temperature of 70° C. Then, the plate was dried for 3 minutes with a forced air stream having a temperature of 300° C. so as to preheate the plate's surface to a temperature of 170 to 190° C.

Next, the preheated, fluxed plate 5808 was dipped for 5 minutes in a conventional galvanizing bath containing (by weight): 4.2–7.2% of Al, max. 50 ppm of Pb, 0.01–0.03% of mischmetals, max. 150 ppm of Si, max. 750 ppm of Fe, max. 50 ppm of Cd, max. 20 ppm of Sn, and essentially the remainder of Zn. This galvanizing bath was maintained at a temperature of 450° C. During the first 3 minutes, the plate was subjected to a reciprocating vertical movement in the galvanizing bath at a speed of 4 m/min. After removal from the galvanizing bath, the plate was allowed to cool down in the air. The plate 5808 exhibited a continuous, void-free and uniform coating. Some very small craters and some flux residues could however be observed. However, the obtained coating quality was very good (far better than the one obtained with conventional fluxes and fluxes developped for Zn—Al alloys).

EXAMPLE 3

A steel pipe, ref. 34, having an outer diameter of 45 mm, a wall thickness of 4 mm and a length of 120 mm was treated according to a third embodiment of the process. The composition (in weight percentages) of pipe 34 was: C: 0.149, Nb: 0.002, Si: 0.272, Pb<0.001, Mn: 1.377, Co: 0.007, P: 0.023, W<0.003, S: 0.015, Al: 0.046, Cr: 0.020, Ni: 0.012, Mo: 0.003, Cu: 0.036, B<0.0001, Ti: 0.002, V: 0.005.

The pipe was first dipped for 15 min in an ultrasonic alkali degreasing bath (as for plate 2130 in Example 1) kept at a temperature of 70° C. and successively rinsed in two rinsing baths. The pipe was then dipped for 60 min in a pickling bath similar to that used for plate 2130 and successively rinsed in rinsing bath 1 (see example 1) and rinsing bath 2, for less than 1 minute. The plate was then subjected to a second, identical degreasing followed by rinsing as well as to a second pickling (pickling bath with 12 to 15% of hydrochloric acid) for 5 min at 30° C., followed by two successive immersions of less than 1 minute each in rinsing baths 1 and 2 (see Example 1).

The pipe was then fluxed in a fluxing bath containing 530 g/l of a flux (composition: 76.6 wt. % $ZnCl_2$, 12.5 wt. % $NH_4Cl$, 0.8 wt. % $NiCl_2$, 0.7 wt. % $PbCl_2$, 7.2 wt. % NaCl, 2.2 wt. % KCl) dissolved in water. The plate was dipped for 3 minutes in the bath which was maintained at a temperature of 70° C. Then, the article was dried for 6 minutes with a forced air stream having a temperature of 250° C. so as to preheated the plate's surface to a temperature of 170 to 190° C.

The preheated, fluxed pipe 34 was then dipped for 5 minutes in a galvanizing bath containing (in percent by weight): 4.94% of Al, 176 ppm of Sb, 15 ppm of Pb, 82 ppm Ce, 56 ppm La, 110 ppm of Si, 129 ppm of Mg, and mainly the remainder of Zn. This galvanizing bath was maintained at a temperature of 450° C. During the 5 minutes the pipe was subjected to a reciprocating vertical movement in the galvanizing bath at a speed of 4 m/min. After removal from the galvanizing bath, the plate was allowed to cool down in the air. The pipe 34 exhibited a continuous, void-free, uniform and perfectly smooth coating (no craters).

What is claimed is:

1. A flux for hot dip galvanization comprising from:

60 to 80 wt. % of zinc chloride ($ZnCl_2$);

7 to 20 wt. % of ammonium chloride ($NH_4Cl$);

2 to 20 wt. % of at least one alkali or alkaline earth metal salt;

0.1 to 5 wt. % of a least one of the following compounds: $NiCl_2$, $CoCl_2$, $MnCl_2$; and 0.1 to 1.5 wt. % of at least one of the following compounds: $PbCl_2$, $SnCl_2$, $BiCl_3$, $SbCl_3$.

2. The flux according to claim 1, characterized in that it comprises from 70 to 78 wt. % of $ZnCl_2$.

3. The flux according to claim 1, characterized in that the it comprises from 11 to 15 wt. % of $NH_4Cl$.

4. The flux according to claim 1, characterized in that it comprises 1 wt. % of $PbCl_2$.

5. The flux according to claim 1, characterized in that the alkali or alkaline earth metals are chosen from the group consisting of Li, Na, K, Rb, Cs, Be, Mg, Ca, Sr, Ba.

6. The flux according to claim 1, characterized in that it comprises 6 wt. % of NaCl and 2 wt. % of KCl.

7. The flux according to claim 1, characterized in that it comprises 1 wt. % of $NiCl_2$.

8. A fluxing bath for hot dip galvanization, characterized in that it comprises a certain amount of the flux defined in claim 1 dissolved in water.

9. The fluxing bath according to claim 8, characterized in that it comprises between 200 and 700 g/l of the flux, preferably between 350 and 550 g/l, most preferably between 500 and 550 g/l.

10. The fluxing bath according to claim 8, characterized in that it is maintained at a temperature between 50 and 90° C., preferably between 60 and 80° C., most preferably of 70° C.

11. The fluxing bath according to claim 8 characterized in that it comprises a non-ionic surfactant in a concentration of between 0.01 to 2 vol. %.

12. A process for the hot dip galvanization of an iron or steel article comprising the following steps:

(a) degreasing the article in a degreasing bath;

(b) rinsing the article;

(c) pickling the article;

(d) rinsing the article;

(e) treating the article in a fluxing bath as defined in claim 8;

(f) drying the article;

(g) dipping the article in a hot dip galvanizing bath to form a metal coating thereon; and (h) cooling the article.

13. The process according to claim 12, characterized in that at step (e) the article is immersed in the fluxing bath for up to 10 minutes, preferably not more than 5 minutes.

14. The process according to claim 12, characterized in that at step (f) the article is dried by means of air at a temperature between 200 and 350° C., preferably 250° C.

15. The process according to claim 12, characterized in that the surface of the article is at a temperature between 170 and 200° C. prior to step (g).

16. The process according to claim 12, characterized in that the galvanizing bath is maintained at a temperature between 380 and 700° C.

17. The process according to claim 12, characterized in that the article is moved in the galvanizing bath.

18. The process according to claim 12, characterized in that an inert gas is injected into the galvanizing bath.

19. The process according to claim 12, characterized in that the article is an individual article which is batchwise passed from steps (a) to (h); or in that the article is a wire, pipe or coil (sheet) material which is continuously guided through steps (a) to (h).

20. The process according to claim 12, characterized in that the galvanizing bath comprises:

from 0 to 56 wt. % of Al;

from 0 to 1.6 wt. % of Si;

with the rest being essentially Zn.

21. The process according to claim 20, characterized in that the galvanizing bath is a molten zinc bath comprising:

either 3–7 wt. % Al, 0–3 wt. % Mg and 0–0.1 wt % Na; or 4.2–7.2 wt % Al and 0.03–0.10 wt. % mischmetals; or 55 wt. % Al and 1.6 wt. % Si.

22. The process according to claim 12, characterized in that the galvanizing bath comprises:

up to 56 wt. % of Al;

from 0.005 to 0.15 wt. % of Sb and/or from 0.005 to 0.15 wt. % of Bi;

maximum 0.005 wt. % of Pb, maximum 0.005 wt. % of Cd and maximum 0.002 wt. % of Sn; and with the rest being essentially Zinc.

23. A hot dip galvanizing bath comprising:

up to 56 wt. % of Al;

from 0.005 to 0.04 wt. % of Sb;

maximum 0.005 wt. % of Pb, maximum 0.005 wt. % of Cd and maximum 0.002 wt. % of Sn; and with the rest being essentially Zn.

24. A hot dip galvanizing bath comprising:

From 2 wt. % to 56 wt. % of Al;

from 0.005 to 0.04 wt. % of Sb and/or from 0.005 to 0.15 wt. % of Bi;

maximum 0.005 wt. % of Pb, maximum 0.005 wt. % of Cd and maximum 0.002 wt. % of Sn; and with the rest being essentially Zn.

25. The hot dip galvanizing bath according to claim 24, characterized in that it comprises: 4.2 to 7.2 wt. % of Al; 0.005 to 0.15 wt. % of Sb and/or 0.005 to 0.15 wt. % of Bi; max. 150 ppm by weight of Si; max. 750 ppm by weight of Fe; max. 0.005 wt. % of Cd; max. 0.002 wt. % of Sn; max. 0.005 wt. % of Pb; with the rest being essentially Zn.

* * * * *